US011509089B1

(12) United States Patent
Atsushi

(10) Patent No.: US 11,509,089 B1
(45) Date of Patent: Nov. 22, 2022

(54) CONNECTOR ASSEMBLY WITH AN ADAPTOR

(71) Applicant: Sumitomo Wiring Systems, Ltd., Yokkaichi (JP)

(72) Inventor: Kurita Atsushi, Farmington Hills, MI (US)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 17/392,732

(22) Filed: Aug. 3, 2021

(51) Int. Cl.
*H01R 13/447* (2006.01)
*H01R 31/06* (2006.01)
*H01R 13/506* (2006.01)

(52) U.S. Cl.
CPC ..... *H01R 13/447* (2013.01); *H01R 13/506* (2013.01); *H01R 31/06* (2013.01)

(58) Field of Classification Search
CPC ..... H01R 31/06; H01R 13/447; H01R 13/06
See application file for complete search history.

(56) References Cited

U.S. PATENT DOCUMENTS 3,950,054 A * 4/1976 Ward ..... H02G 3/16 248/220.21
11,101,606 B2 * 8/2021 Kurita ..... H01R 13/688

* cited by examiner

*Primary Examiner* — Briggitte R. Hammond
(74) *Attorney, Agent, or Firm* — Honigman LLP

(57) ABSTRACT

A connector assembly is configured to mate a first connector housing. The connector assembly includes a second connector, a second terminal, a second connector housing, an adaptor and a cover. The second connector housing accommodates the second terminal and includes an opening for providing access to the second terminal. The adaptor is coupled to the second connector housing. The cover is detachably mounted to the adaptor, wherein the adaptor is movable between a first position and a second position. In the first position the cover is separated from the opening of the second connector housing so as to provide access to the first terminal and the second terminal. In the second position the cover is closes the opening of the second connector housing.

17 Claims, 12 Drawing Sheets

CONNECTOR ASSEMBLY WITH AN ADAPTOR

TECHNICAL FIELD

The present disclosure generally relates to a connector assembly having an adaptor.

BACKGROUND

A connector assembly is configured to provide an electric connection to an electric device. The connector assembly includes a first connector housing and a second connector housing each having a respective terminal for making an electrical connection. In some aspects, the second connector housing includes an opening for providing access to the connected terminals. A service cover is configured to close the opening.

The service cover and the second connector housing are separate pieces which require each to be managed separately until during installment. As an example, the service cover is installed after the terminals are secured to each other by a fastening component. Additionally, the installer must physically orient the service cover onto the second connector housing. Such steps increases the complexity of the installation process.

Accordingly, it remains desirable to have a connector assembly wherein the service cover does not require handling so as to decrease the complexity of installation relative to current practice. In particular, to eliminate the need to manage the cover and the second connector housing separately. It further remains desirable to have a connector assembly configured to assist in the positioning of the service cover onto the opening.

SUMMARY

In one aspect of a connector assembly the connector assembly is configured to mate a first connector housing. The first connector housing includes a first terminal electrically connected to a wire. The connector assembly includes a second connector, a second terminal, a second connector housing, an adaptor and a cover.

The second terminal is configured to be mounted on an end part of the wire and also to be electrically connected to the first terminal. The second connector housing is configured to accommodate the second terminal. The second connector housing includes an opening for providing access to the second terminal. The adaptor is coupled to the second connector housing. The adaptor is movable with respect to the second connector housing.

The cover is detachably mounted to the adaptor, wherein the adaptor is movable between a first position and a second position. The second position is different from the first position. In the first position the cover is separated from the opening of the second connector housing so as to provide access to the first terminal and the second terminal. Accordingly, the first terminal and the second terminal are accessible for installation and servicing. For instance, the opening provides access for a first fastening member to secure the first terminal to the second terminal. In the second position the cover closes the opening of the second connector housing, so as to protect the first terminal and the second terminal from environmental conditions such as rain, mud and the like.

In one aspect, the second connector housing includes an inner housing made of resin and an outer housing made of metal. The outer housing is configured to accommodate the inner housing. The second terminal is disposed within the inner housing. The outer housing includes an electrically connecting portion electrically connectable to the device case. The electrically connecting portion is arranged inside the outer housing.

The adaptor is mounted on the outer housing of the second connector housing. The opening includes a first opening formed in the inner housing and a second opening formed in the outer housing, wherein the first opening overlaps the second opening. When the adaptor is in the first position, the cover is separated from the second opening of the outer housing and the device case, wherein the electrically connecting portion is accessible so as to provide access to fasten the second device case to the electrically connecting portion via the fastening member.

In yet another aspect, the connector assembly includes a plurality of the second terminals and a plurality of the inner housings. The plurality of second terminals are individually accommodated in the plurality of inner housings and the plurality of inner housings are accommodated side by side in the outer housing. In such an aspect, the electrically connecting portion is arranged between the plurality of inner housings.

In yet another aspect, the wire includes a core, a first insulation coating surrounding the core, a braided wire surrounding the first insulation coating and a second insulation coating surrounding the braided wire. The second connector includes a shield retainer to be accommodated into the outer housing and mounted in the outer housing. The wire includes a shield connecting portion exposed from the second insulation coating, and the shield retainer is electrically connected to the shield connecting portion and electrically connected to the outer housing.

In yet another aspect, the shield retainer is fastened to the outer housing by a third fastening member.

In yet another aspect, the shield retainer includes a first divided body and a second divided body separable from the first divided body.

In yet another aspect, the adaptor includes a first locking portion lockable to the second connector housing when in the first position. The second connector housing includes a first adaptor holding portion. The first locking portion is configured to lock to the first adaptor holding portion. The first locking portion is locked to the first adaptor holding portion when the adaptor is at the first position.

The adaptor may further include a second locking portion configured to lock to the second connector housing. The second connector housing includes a second adaptor holding portion. The second locking portion is configured to lock to the second adaptor holding portion. The second locking portion is locked to the second adaptor holding portion when the adaptor is at the second position. The adaptor may further include a lock portion for releasing a locked state of the second locking portion to the second connector housing.

In yet another aspect, the second connector includes a pair of first projections and a pair of second projections and the adaptor includes a pair of first guide rails and a pair of second guide rails, wherein the pair of first projections are configured to be slidingly disposed within the pair of first guide rails and the pair of second projections are configured to be slidingly disposed within the pair of second projections. The pair of first projections are arranged on opposite sides of the second connector housing and the pair of second projections are also arranged on opposite sides of the second connector housing. The pair of first guide rails are spaced apart from and extend along the pair of second guide rails, wherein the adaptor is movable between the first position and the second position by sliding the first projections within a respective one of the pair of first guide rails and sliding the second projections within a respective one of the pair of second guide rails.

In yet another aspect of the connector assembly, the electrically connecting portion is electrically connectable to the device case by being fastened to the device case by a second fastening member.

Also provided herein is a connector system. The connector system is configured to be installed in a vehicle so as to provide an electrical connection to an electric device. The connector system includes a first connector to be mounted on a device case of an in-vehicle device. The device case houses the electric device. The connector system includes a second connector to be engaged with the first connector. A first fastening member fixes the second connector to the first connector. The first connector includes a first terminal and a first connector housing for holding the first terminal.

The second connector includes a second terminal fastened to the first terminal by the first fastening member so as to electrically connect the second terminal to the first terminal. A second connector housing accommodates the second terminal. An adaptor is mounted on the second connector housing, the adaptor being relatively movable with respect to the second connector housing. A cover is detachably mounted on the adaptor.

The second connector housing includes an opening for providing access to the second terminal. The adaptor is movable between a first position and a second position. The second position is different from the first position, wherein when the adaptor is in the first position the cover is separated from the opening of the second connector housing so as to provide access to the first terminal and the second terminal, and when the adaptor is in the second position, the cover closes the opening of the second connector housing.

In one aspect, the first connector housing includes a guide portion extending upwardly from a base of the connector housing and the second connector housing includes a guided portion provided on an outer side surface of the second connector housing and having a groove shape which is open to a bottom edge of the second connector housing. The guided portion is slidable with respect to the guide portion. The guide portion may include a third locking portion configured to be locked to the second connector housing and the guided portion includes a first connector holding portion. In particular, the third locking portion is configured to be locked to the first connector holding portion.

In one aspect, the adaptor covers the guide portion when placed at the second position.

In yet another aspect of a connector assembly, the connector assembly is configured to mate with a first connector. The first connector includes a first connector housing for holding a first terminal and is configured to be mounted on a metal-made device case of an in-vehicle device. The first connector housing is capable of accommodating a second terminal electrically connectable to the first terminal.

The connector assembly includes a second connector housing, an adaptor and a cover. The second connector housing accommodates the second terminal. The cover is detachably mounted to the adaptor. The adaptor is configured to be mounted on the second connector housing. The adaptor is movable with respect to the second connector housing.

The second connector housing includes an opening for providing access to the second terminal. The adaptor is movable between a first position and a second position different from the first position. In the first position the cover is separated from the opening of the second connector housing and the first terminal and the second terminals are accessible so as to be fastened to each other by a first fastening member. In the second position, the cover closes the opening of the second connector housing.

In one aspect, the second connector housing includes an outer housing made of metal and capable of accommodating an inner housing. The outer housing includes an electrically connecting portion electrically connectable to the device case by being fastened to the device case. The electrically connecting portion is electrically connected to the device case by a second fastening member. The electrically connecting portion is arranged inside the outer housing. When the adaptor the first position, the cover is separated from the opening of the outer housing so as to make the device case and the electrically connecting portion accessible for fastening by the second fastening member. When the adaptor is in the second position, the cover closes the opening so as to protect the electrically connecting portion and the device case.

Accordingly, a connector assembly and a connector system is provided wherein the service cover does not require handling so as to decrease the complexity of installation relative to current practice. Further the connector assembly and connector system disclosed herein is configured to assist in the positioning of the service cover onto the opening.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

DETAILED DESCRIPTION OF PREFERRED EMBODIMENTS

Figure 1:
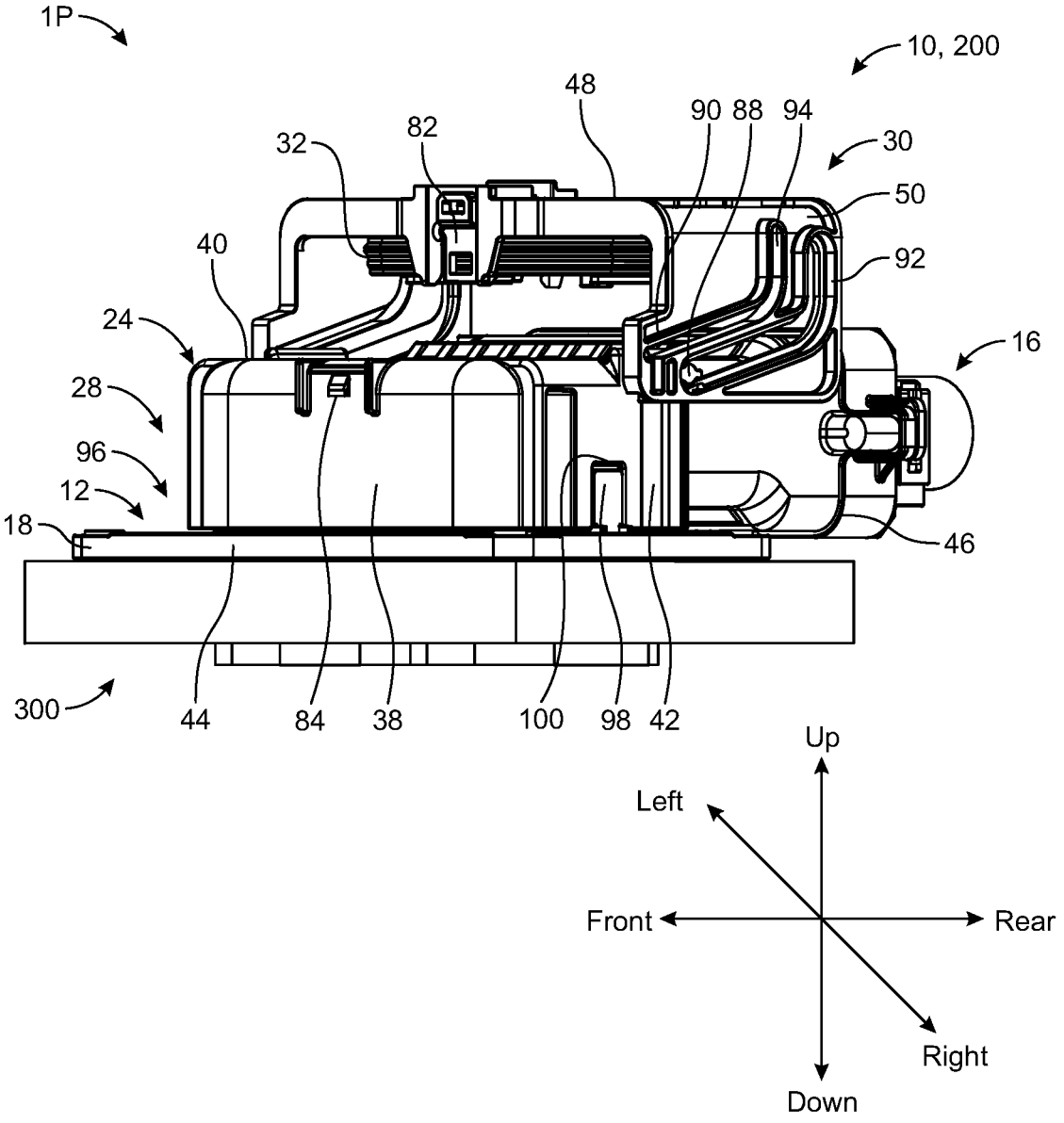
FIG. 1 is an exemplary depiction of a connector assembly in a first position according to one or more embodiments illustrated herein.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed. Positional terms, such as "rear," "front," "left," "right," "up," "down," and derivative terms thereof are made in reference to the directions of the arrows provided in the accompanying figure.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Referring generally to the figures, embodiments of the present disclosure include a connector assembly. The connector assembly is configured to mate with a first connector housing. The connector assembly includes a second connector, a second terminal, a second connector housing, an adaptor and a cover. The second connector housing is configured to accommodate the second terminal and an opening for providing access to the second terminal.

The adaptor is coupled to the second connector housing. The adaptor is movable with respect to the second connector housing. The cover is detachably mounted to the adaptor, wherein the adaptor is movable between a first position and a second position. In the first position the cover is separated from the opening of the second connector housing so as to provide access to the first terminal and the second terminal. In the second position the cover closes the opening of the second connector housing. Accordingly, in the first position the first terminal and the second terminal are accessible for installation and servicing and in the second position the cover protects the first terminal and the second terminal from environmental conditions such as rain, mud and the like.

With reference first to FIGS. 1-3*b*, a first aspect of a connector assembly 10 is provided. The connector assembly 10 is configured to mate with a first connector housing 12. The first connector housing 12 may be configured to electrically connect to an electric device (not shown) installed in a vehicle (not shown). For illustrative purposes the connector assembly is shown as being configured to mount to a device case 300 of the electric device. The first connector housing 12 includes a first terminal 14 electrically connected to a wire 16 for supplying power to the electric device via the first terminal 14. The first terminal 14 is formed of an electrically conductive material and is illustratively shown as being a post shaped member having a threaded bore.

Figure 3A:
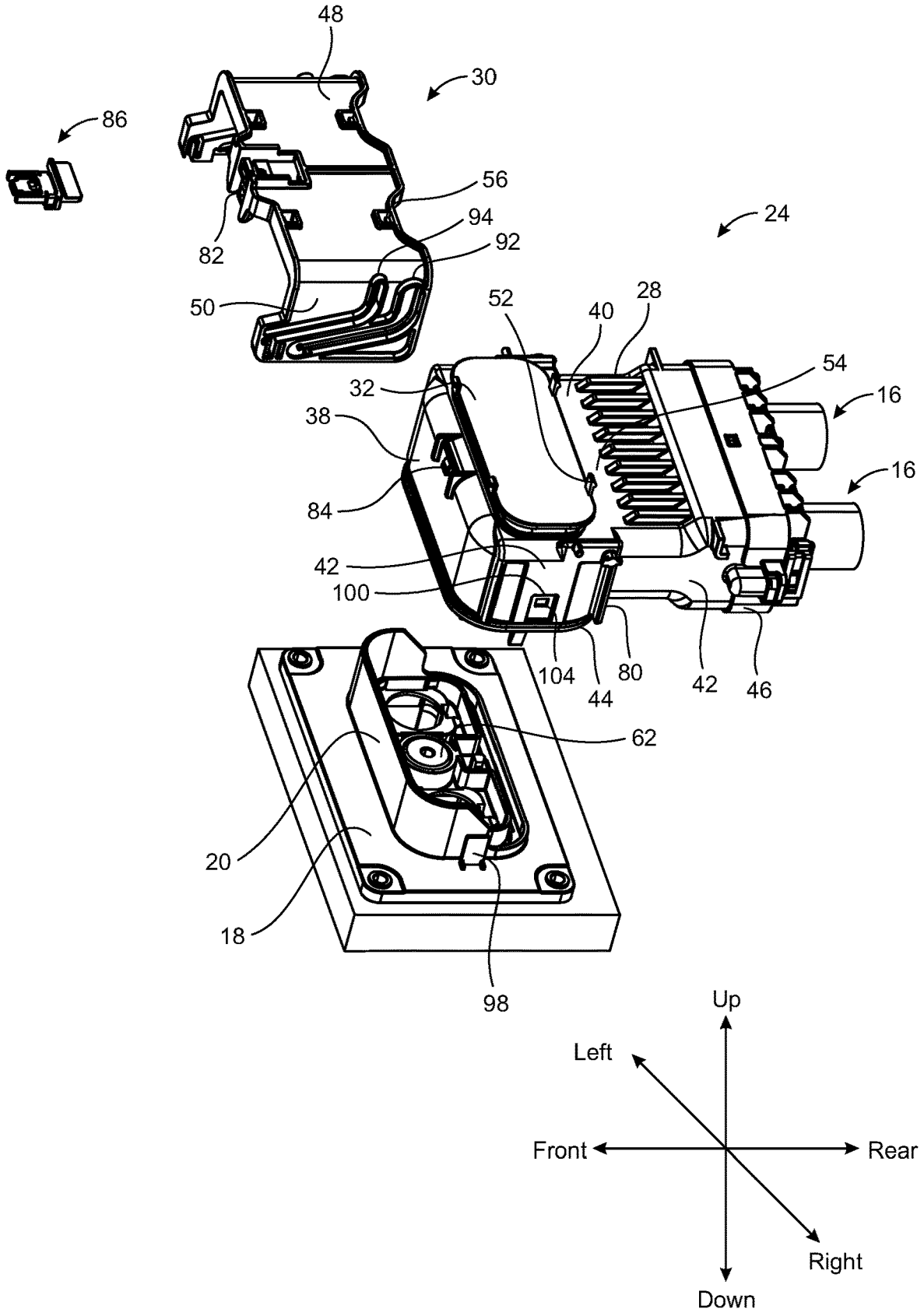
FIG. 3*a* is an exploded view of the connector assembly shown in FIG. 1.
Figure 3B:
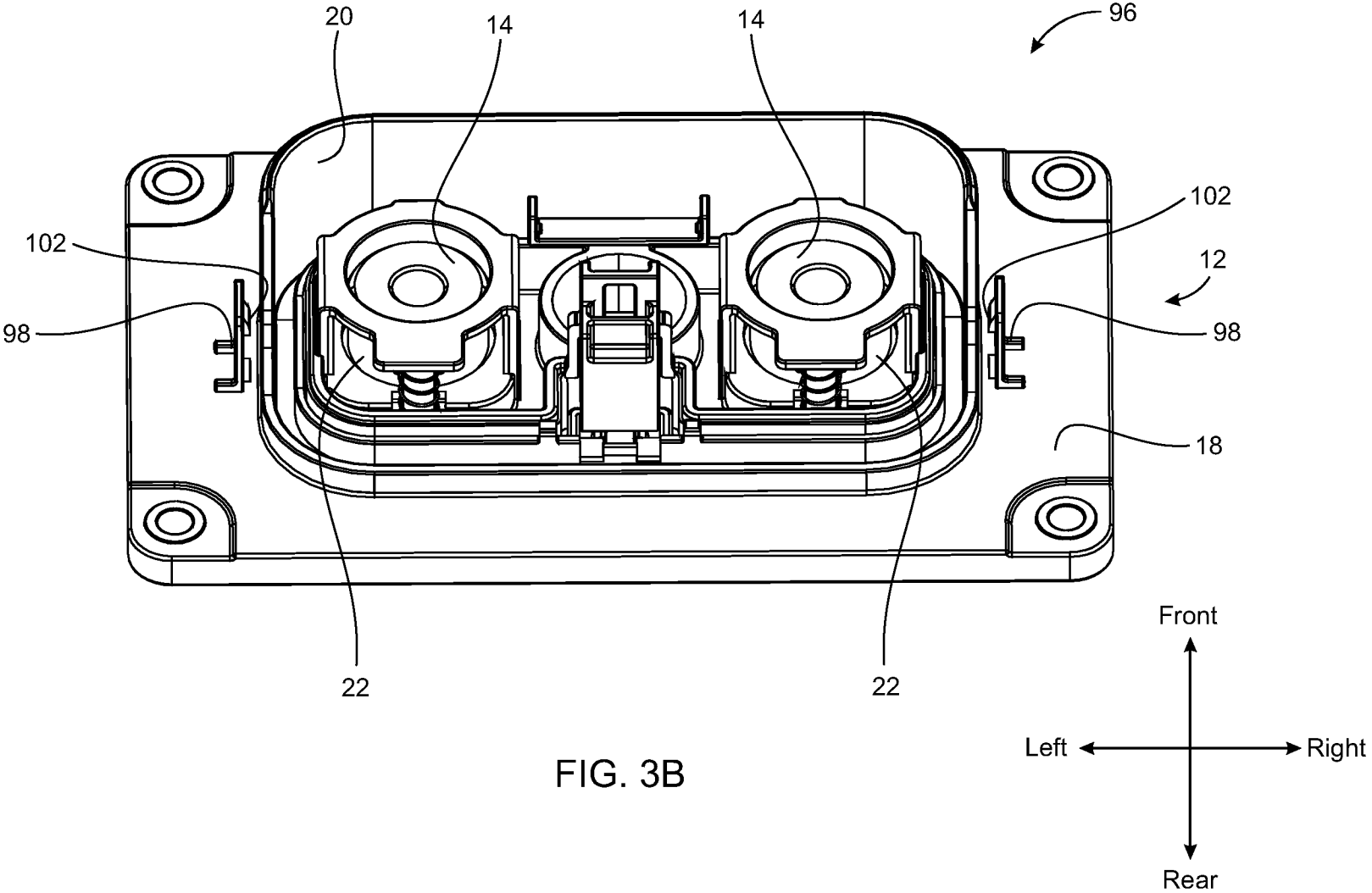
FIG. 3*b* is an isolated view of the first connector shown in FIG. 3*a*.

The first connector housing 12 may be adapted for installation onto a substrate (not shown) of the vehicle using known fastening mechanisms, such as a threaded bolt, tabs, clamps and the like. In one aspect, the first connector housing 12 includes a base 18 and a housing portion 20 projecting upwardly from the base 18. In one aspect, as shown in FIG. 3*b*, the base 18 is a generally planar member having a plurality of apertures 22 for which the first terminals 14 are passed through. In this particular aspect, the base 18 is shown as having a pair of apertures 22 for receiving a respective first terminal 14. The housing portion 20 bounds a portion of the periphery of the apertures 22. In particular, the housing portion 20 projects upwardly from a front of the apertures 22 of the base 18.

The connector assembly 10 further includes a second connector 24, a second terminal 26, a second connector housing 28, an adaptor 30 and a cover 32. The second terminal 26 is formed of an electrically conductive material and is illustratively shown as being a plate shaped member having a bore. The second terminal 26 is configured to be mounted on an end part of the wire 16 and to be electrically connected to the first terminal 14. In particular, electrically coupling the second terminal 26 to the first terminal 14 requires the bore of the first terminal 14 to align with the bore of the second terminal 26, wherein a first fastening member 34, illustratively shown as a bolt, is inserted into the respective bores and threaded into the threaded bore of the first terminal 14. As such as electrical connection is made between the electrical device and a power supply (not shown).

The second connector housing 28 is configured to be mounted onto the first connector housing 12. The second connector housing 28 is further configured to accommodate the second terminal 26. The second connector housing 28 includes an opening 36 for providing access to the second terminal 26. In one aspect, the second connector housing 28 includes a front wall 38, a top wall 40 and a pair of side walls 42 so as to define an open bottom 44 and an open back 46. The open bottom 44 of the second connector housing 28 is simply mounted onto the base 18 of the first connector housing 12. The side walls 42 and the front wall 38 of the second connector housing 28 bound the housing portion 20 of the first connector housing 12. The top of the first connector housing 12 is closed by the top wall 40 of the second connector housing 28 and the back of the first connector housing 12 is open so as to accommodate the wire 16.

The adaptor 30 is coupled to the second connector housing 28. The adaptor 30 has a top portion 48 and a pair of side portions 50 disposed on opposite sides of the top portion so as to define a generally U-shaped cross section. The adaptor 30 is movable with respect to the second connector housing 28. In particular, the adaptor 30 is movable between a first position (1P) and a second position (2P). The second position is different from the first position. In the first position (1P), shown in FIGS. 1 and 4, the cover 32 is separated from the opening 36 of the second connector housing 28 so as to provide access to the first terminal 14 and the second terminal 26. In the second position (2P), shown in FIGS. 2, 5 and 6, the cover 32 is seated within the opening 36 of the second connector housing 28.

Figure 4:
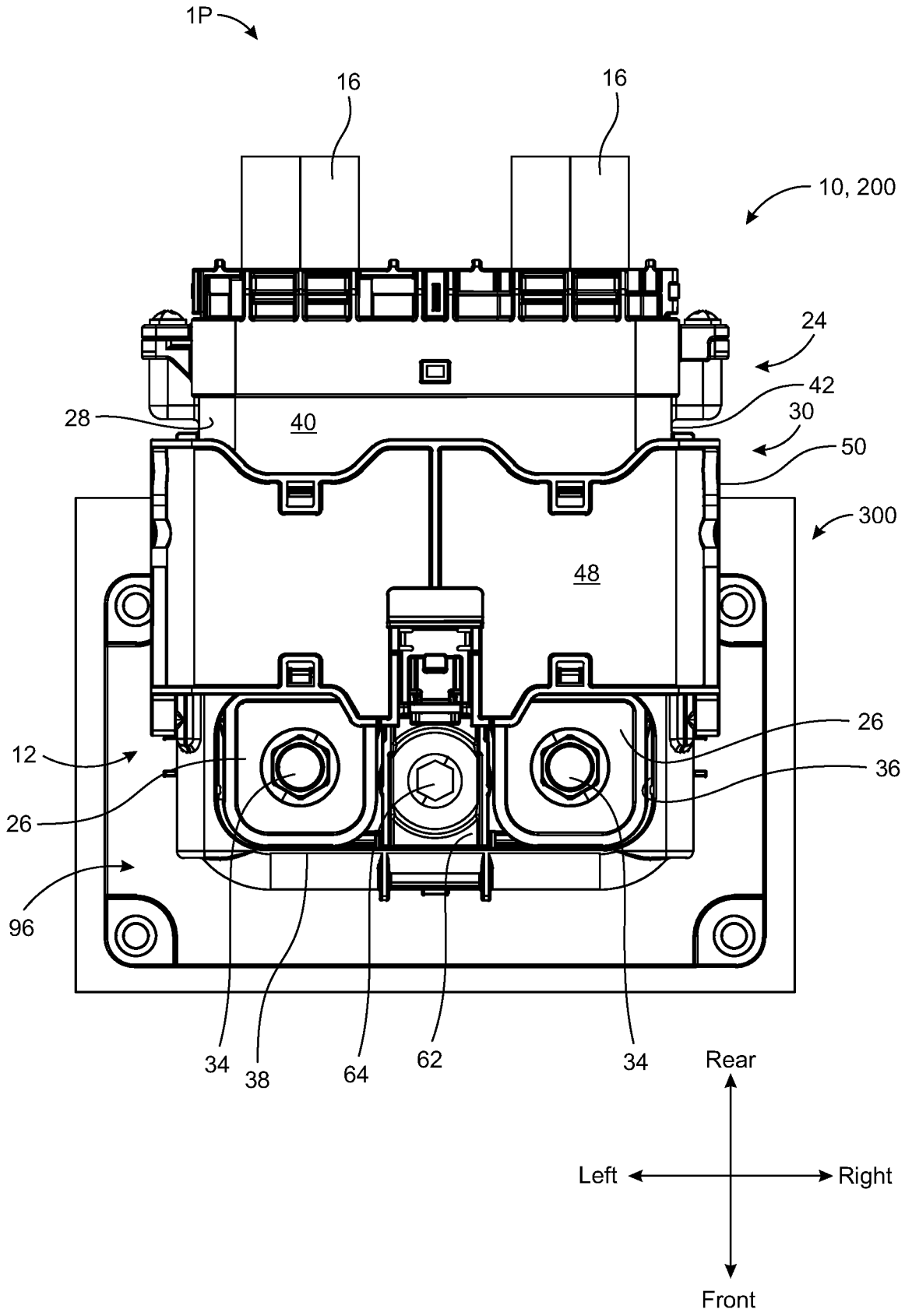
FIG. 4 is top down view of the connector assembly shown in FIG. 1.
Figure 10A:
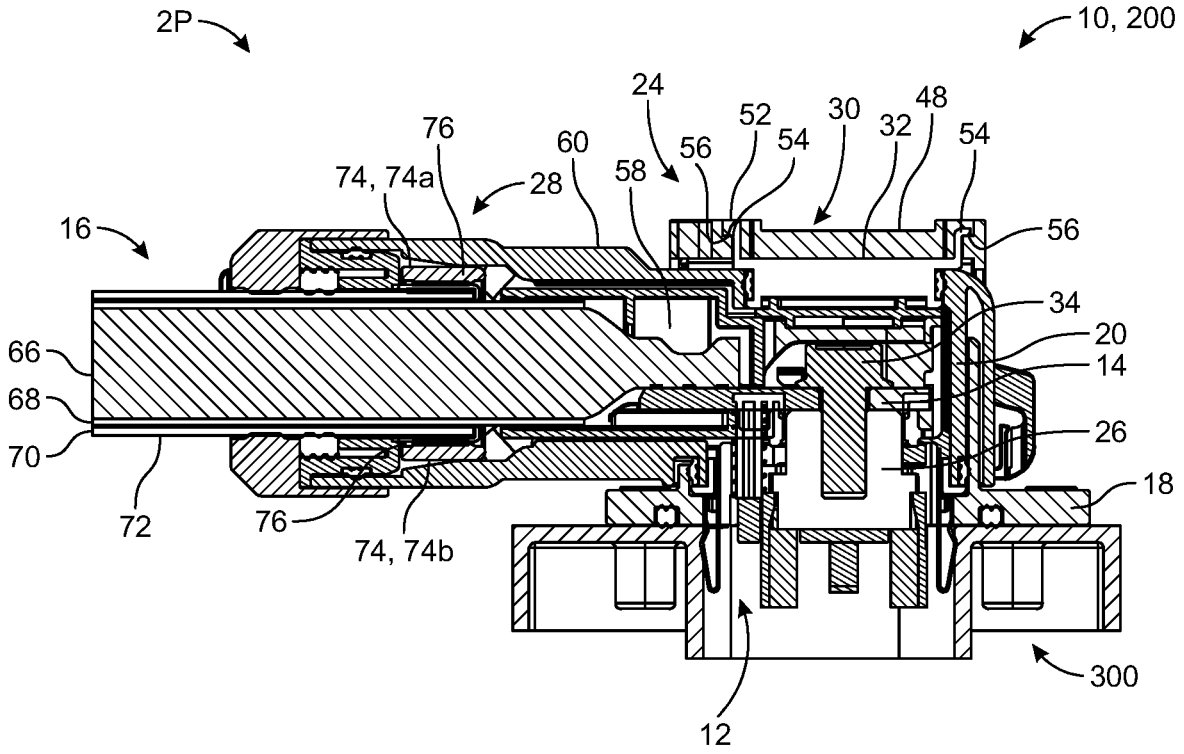
FIG. 10A is a cross-sectional view of the connector assembly shown in FIG. 6 taken along line 10-10.

The cover 32 is detachably mounted to the adaptor 30. Specifically, the cover 32 is detachably mounted to a bottom surface of the top portion 48 of the adaptor 30. In one aspect, the cover 32 includes a plurality of tabs 52 projecting upwardly from a top surface of the cover 32. As an example, the cover 32 includes four tabs 52 disposed approximate to each corner of the cover 32. The tabs 52 include a catch 54 disposed on a distal end of each tab 52. The tabs 52 are positioned so as to be registered with a corresponding engagement feature 56 of the adaptor 30. The engagement feature 56 is illustratively shown as a slot having a respective lip for engaging the catch 54 of a respective tab 52. In such a manner, the cover 32 is detachably coupled to the bottom surface of the adaptor 30 as shown in FIGS. 4 and 10A. The cover 32 is dimensioned to be seated within the opening 36 of the second connector housing 28 so as to close the opening 36. In one aspect, a gasket may be configured to bound a periphery of the cover 32 so as to provide a water tight seal when the cover 32 is seated within the opening 36.

Accordingly, when the adaptor 30 is in the first positon (1P) the first terminal 14 and the second terminal 26 are accessible for installation and servicing, as shown in FIGS. 1 and 4. In particular, when the adaptor 30 is in the first position (1P), the adaptor 30 is positioned proximate the rear of the second connector housing 28 and above and spaced apart from the top wall 40 of the second connector housing 28. In such a position, the opening 36 of the second connector housing 28 is unobstructed and servicing or installation may be performed. For instance, the opening 36 provides access for a first fastening member 34 to secure the first terminal 14 to the second terminal 26.

With reference now to FIGS. 2 and 5-7, the adaptor 30 is shown in the second position (2P). In the second position (2P) the cover 32 is closes the opening 36 of the second connector housing 28, so as to protect the first terminal 14 and the second terminal 26 from environmental conditions such as rain, mud and the like. As shown in the figures, the adaptor 30 automatically positions the cover 32 to be seated within the opening 36. In the second position (2P), the cover 32 closes the opening 36 so as to protect the contents of the second connector housing 28, such as the first terminal 14, the second terminal 26, from environmental conditions to include rain, mud and the like.

With reference now to FIG. 4, in one aspect, the second connector housing 28 may further include an inner housing 58 made of resin and an outer housing 60 made of metal for accommodating the inner housing 58. The front wall 38, top wall 40, and side walls 42 define the outer housing 60. The inner housing 58 is a generally cuboidal member with an open back configured to receive the second terminal 26 and the end portion of the wire 16. Accordingly, the second terminal 26 is disposed within the inner housing 58. In one aspect, the second connector housing 28 includes a pair of inner housings 58, each configured to receive a respective second terminal 26 and wire.

In yet another aspect of the connector assembly 10, the outer housing 60 may further include an electrically connecting portion 62 electrically connectable to the device case 300. The electrically connecting portion 62 is arranged inside the outer housing 60 and may be disposed between a pair of inner housings 58. As shown in FIG. 4, the opening 36 provides access to the electrically connecting portion 62 in addition to the first terminal 14 and the second terminal 26.

Figure 9:
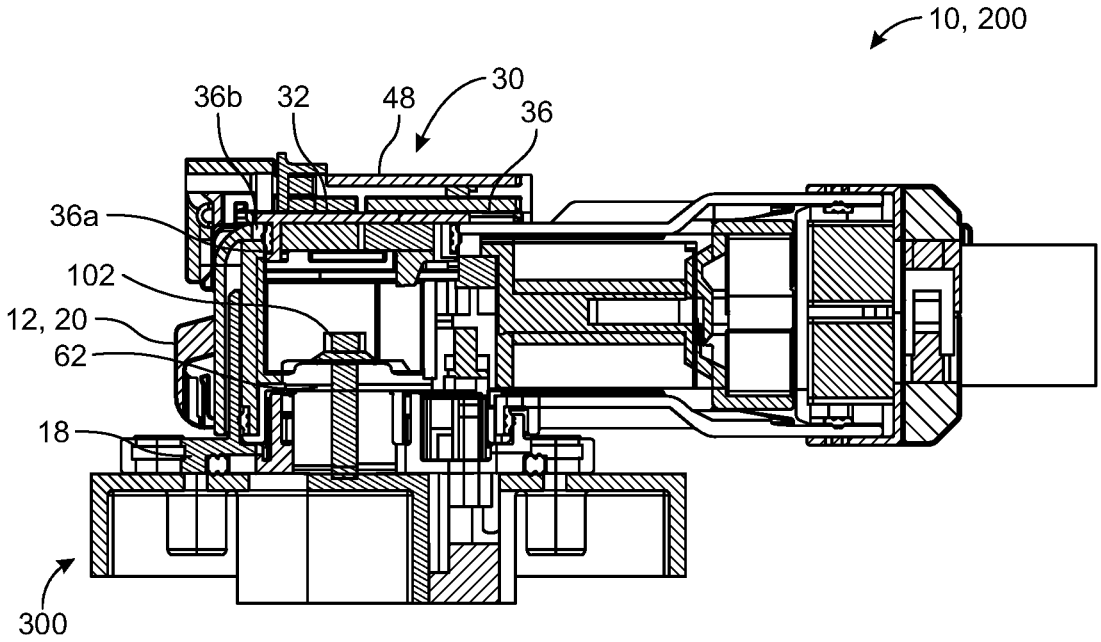
FIG. 9 is a cross-sectional view of the connector assembly shown in FIG. 6 taken along line 9-9.

With reference now to FIG. 9, in one aspect of the opening 36, the opening 36 includes a first opening 36*a* formed in the inner housing 58 and a second opening 36*b* formed in the outer housing 60, wherein the first opening 36*a* overlaps the second opening 36*b*. When the adaptor 30 is in the first position, the cover 32 is separated from the second opening 36 of the outer housing 60 and the device case 300 wherein the electrically connecting portion 62 is accessible so as to provide access to fasten the second device case 300 to the electrically connecting portion 62 via a second fastening member 64, illustratively shown as a bolt.

In yet another aspect, the connector assembly 10 includes a plurality of the second terminals 26 and a plurality of the inner housings 58. The plurality of second terminals 26 are individually accommodated in the plurality of inner housings 58 and the plurality of inner housings 58 are accommodated side by side in the outer housing 60. In such an aspect, the electrically connecting portion 62 is arranged between the plurality of inner housings 58. The connector assembly 10 is illustratively shown as having a pair of second terminals 26, a pair of first terminals 14 each of which is housed within a respective one of a pair of inner housings 58. However, it should be appreciated that the connector assembly 10 may include a single first terminal 14, a single second terminal 26 and a single inner housing 58 or three or more of each without deviating from the scope of the appended claims.

Figure 8:
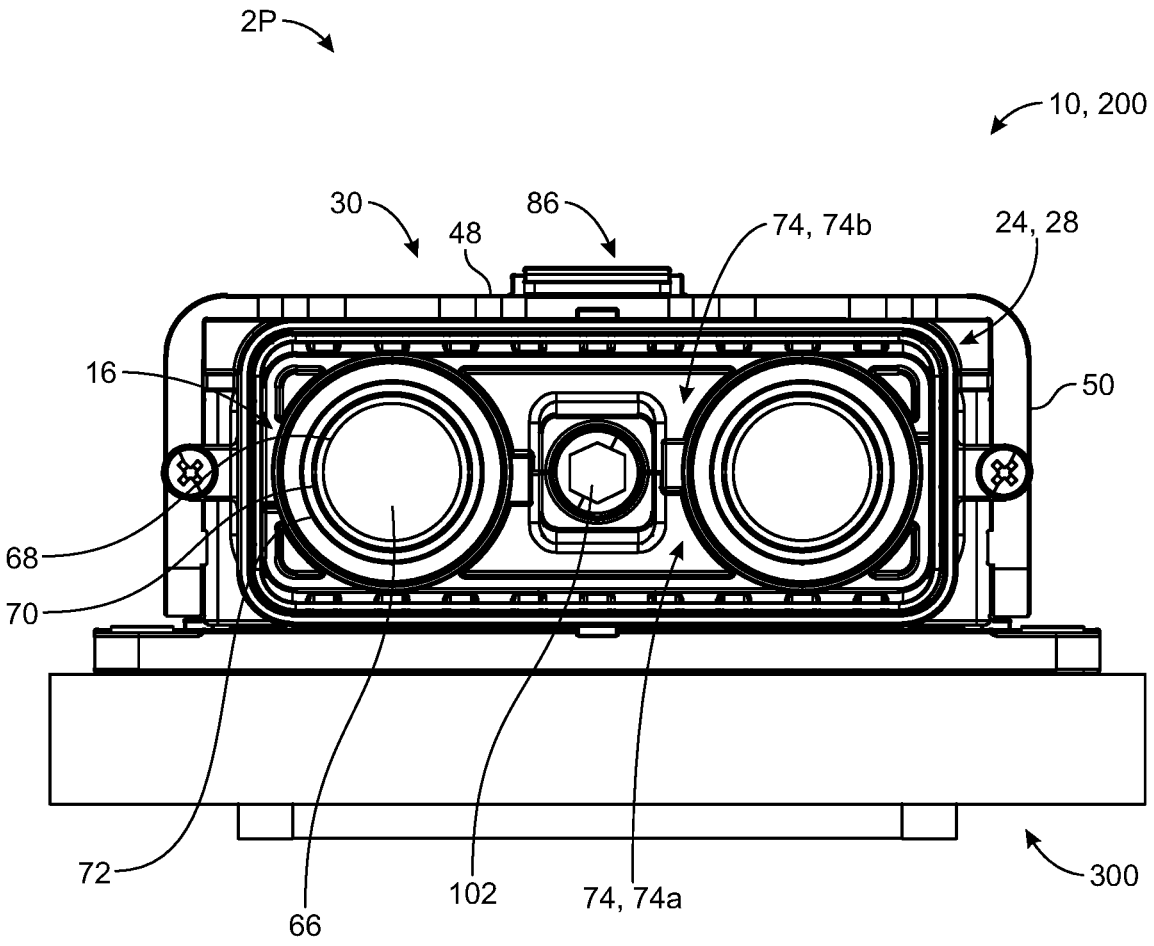
FIG. 8 is a view of the connector assembly shown in FIG. 7 taken from the rear.

With reference now to FIG. 8, an aspect of the wire 16 for use in the connector assembly 10 is provided. The wire 16 may include a core 66, a first insulation coating 68 surrounding the core 66, a braided wire 70 surrounding the first insulation coating 68 and a second insulation coating 72 surrounding the braided wire 70. The second connector 24 includes a shield retainer 74. The shield retainer 74 is disposed within the outer housing 60 and mounted in the outer housing 60. The shield retainer 74 is a block member having a cylindrical through hole. The shield retainer 74 is configured to maintain an axial extension of the wire 16. The shield retainer 74 is fastened to the outer housing 60 by a third fastening member.

Figure 10B:
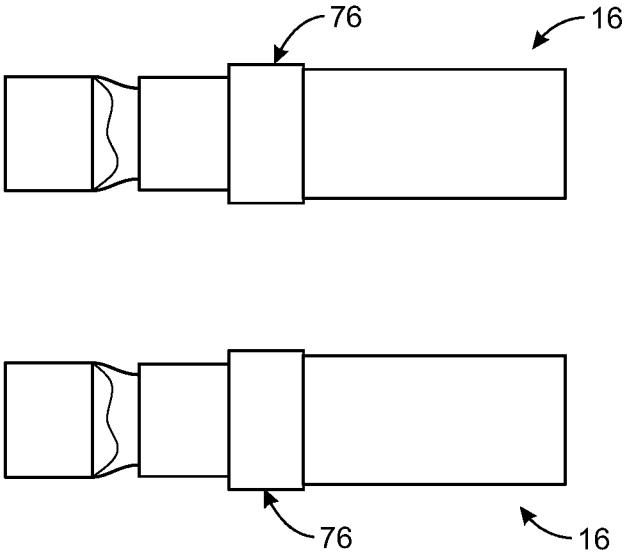
FIG. 10B is a top down view of a pair of wire showing the shield connecting portion.

With reference now to FIG. 10B, the wire 16 may further include a shield connecting portion 76 concentric to the second insulation coating 72. The shield connecting portion 76 is a cylindrical sleeve covering a portion of a respective wire 16. The shield connecting portion 76 is seated within the cylindrical through hole of the shield retainer 74 so as to electrically connect to the shield connecting portion 76 and electrically connected to the outer housing 60. In one aspect, the shield retainer 74 includes a first divided body 74*a* and a second divided body 74*b* separable from the first divided body 74*a*.

Figure 5:
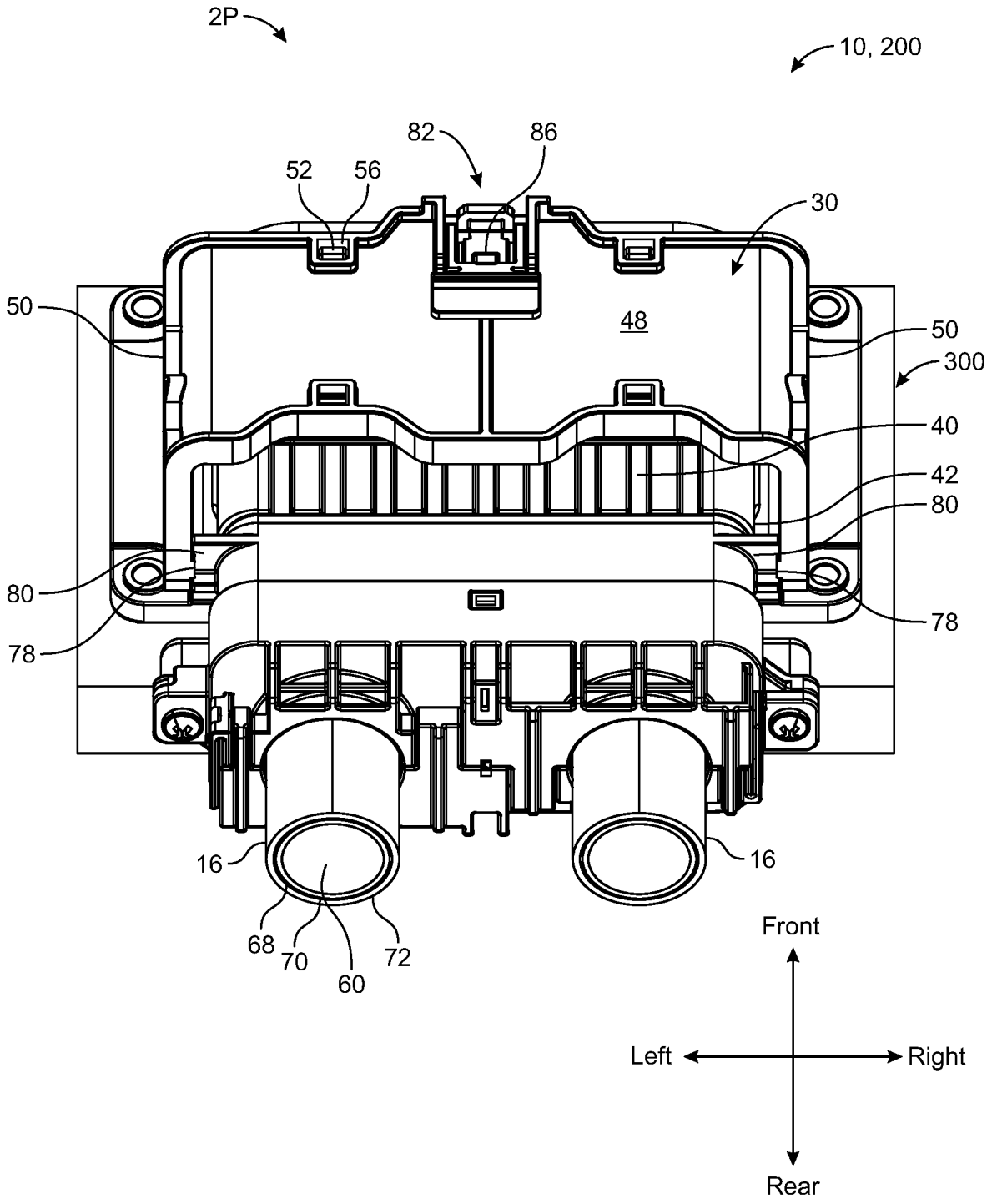
FIG. 5 is a perspective view of the connector assembly shown in FIG. 2 taken from the top.
Figure 6:
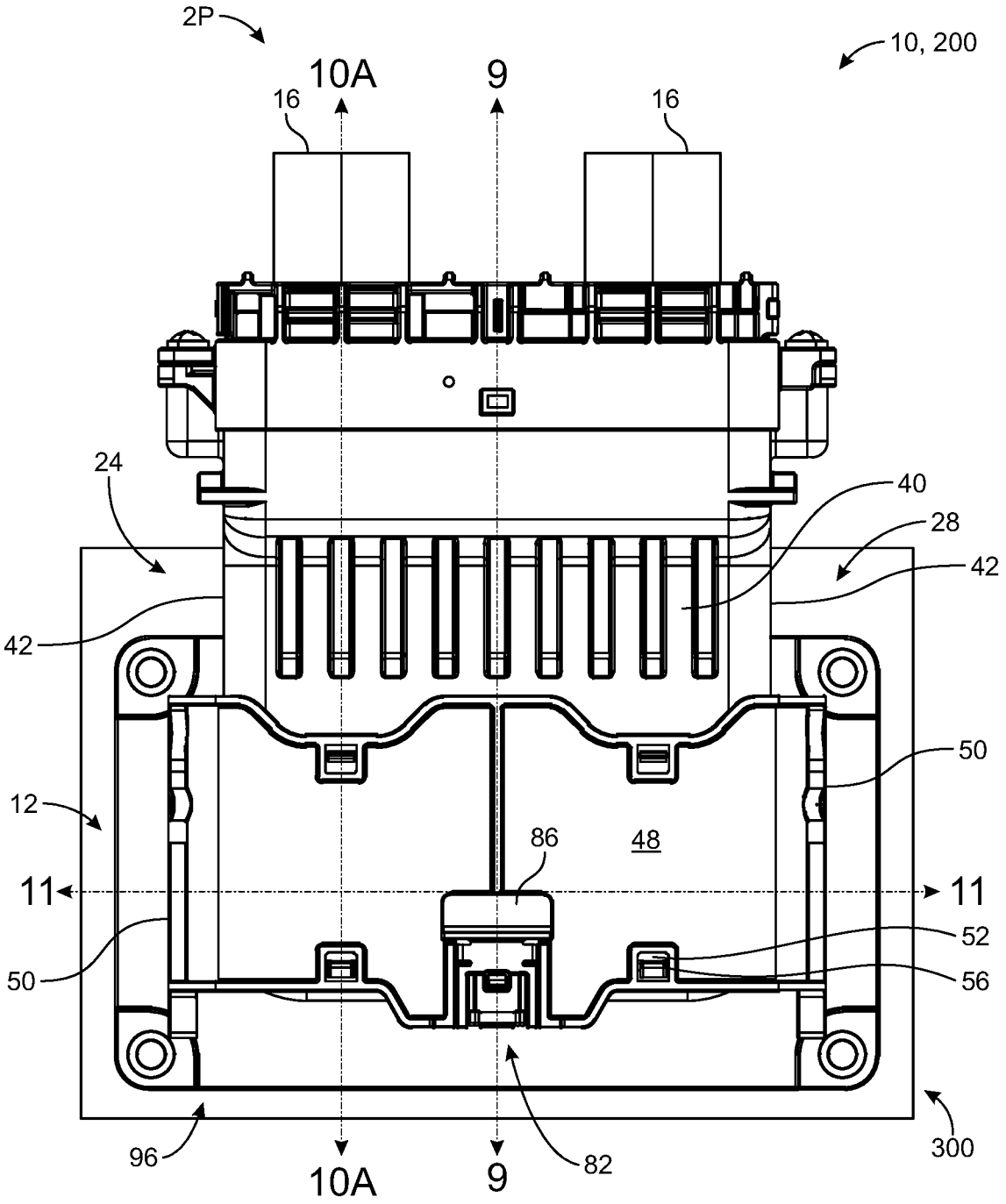
FIG. 6 is a top down view of the connector assembly shown in FIG. 5.

With reference now to FIG. 5, in another aspect, the adaptor 30 includes a first locking portion 78 lockable to the second connector housing 28 when in the second position (2P). In one aspect, the first locking portion 78 is configured to facilitate a mechanical attachment between the adaptor 30 and the second connector housing 28. As illustratively shown, the first locking portion 78 is disposed on the rear peripheral edge of the adaptor 30 and extends towards a center of the adaptor so as to be a tab like structure.

The second connector housing 28 includes a first adaptor holding portion 80. The first adaptor holding portion is illustratively shown as an elongated wall projecting outwardly from the body of the second connector housing 28. The first locking portion 78 being lockable to the first adaptor 30 holding portion. The second housing 28 being dimensioned so as to place the first locking portion 78 in engagement with the first adaptor holding portion when the adaptor 30 is at the second position (2P).

The adaptor 30 may further include a second locking portion 82 lockable to the second connector housing 28, the second connector housing 28 includes a second adaptor holding portion 84. The second locking portion 82 is lockable to the second adaptor holding portion 84, and the second locking portion 82 is locked to the second adaptor holding portion 84 when the adaptor 30 is at the second position (2P). In one aspect, the second locking portion 82 is disposed on the front end of the adaptor 30 and the second adaptor holding portion 84 is disposed on top portion of the front wall 38 of the second connector housing 28. The adaptor 30 may further include a lock portion 86 for releasing a locked state of the second locking portion 82 to the second connector housing 28.

Figure 2:
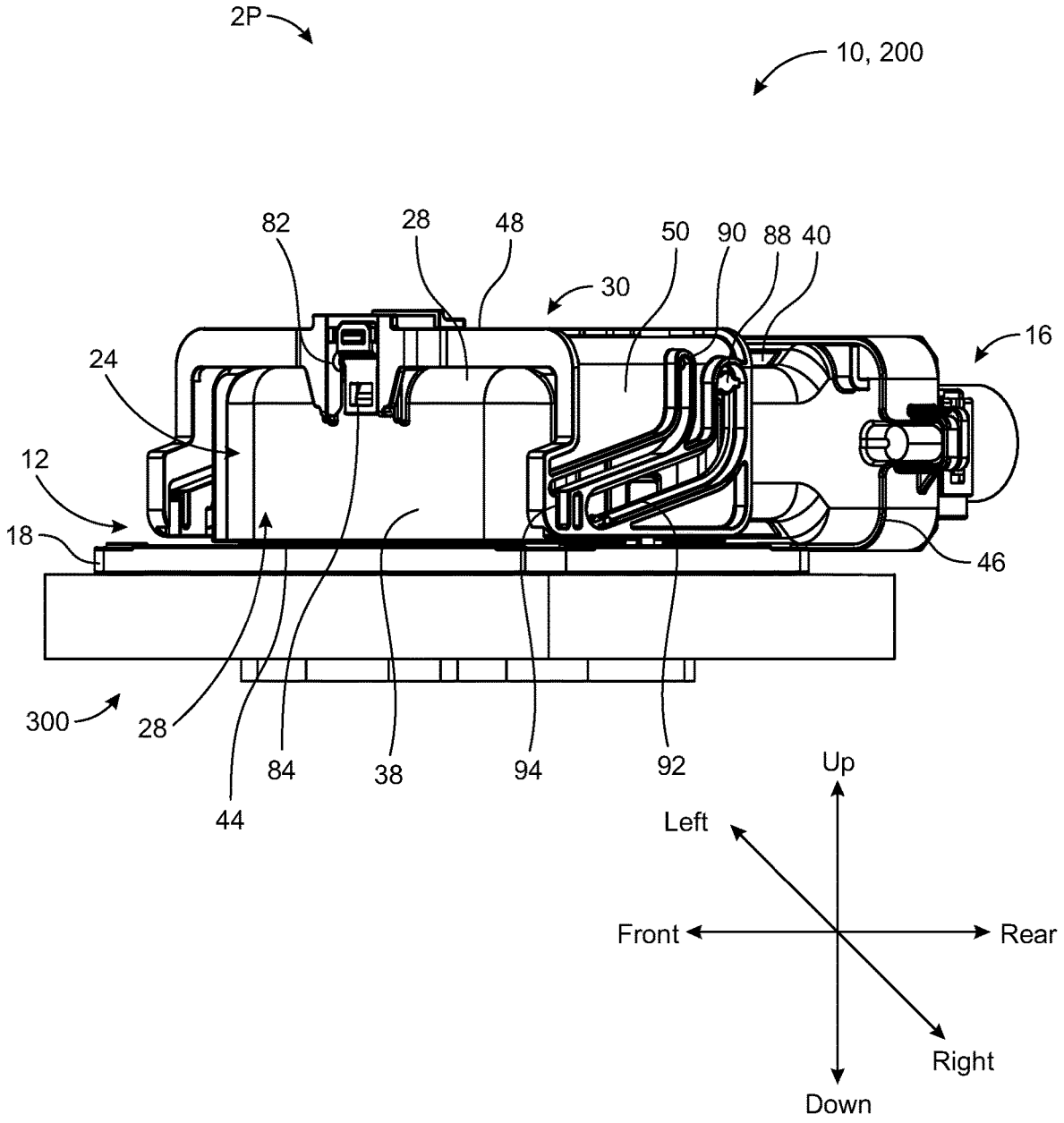
FIG. 2 is a view of the connector assembly shown in FIG. 1 in the second position.
Figure 7:
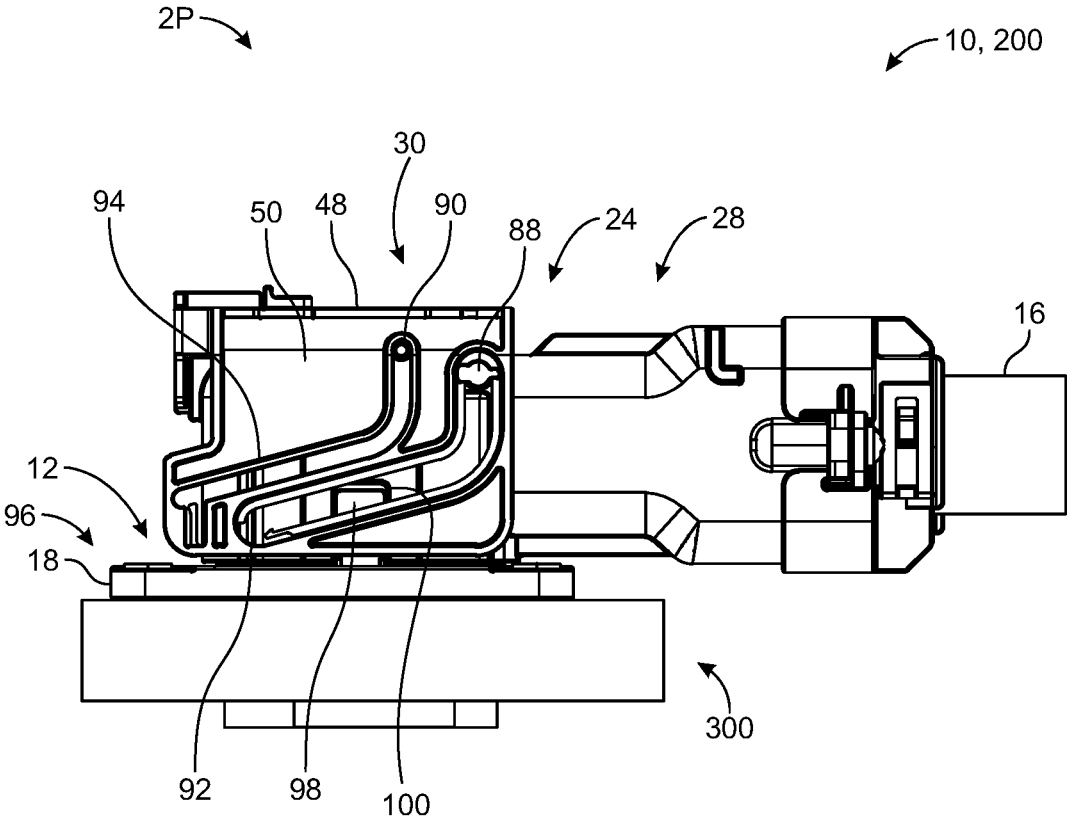
FIG. 7 is a side view of the connector assembly shown in FIG. 6.

With reference now to FIGS. 1, 2 and 7 another aspect of the connector assembly 10 is provided. In this aspect, the second connector 24 may further include a pair of first projections 88 and a pair of second projections 90. Each of the pair of first projections 88 are disposed on a respective side wall 42 of the second connector housing 28 and adjacent the top wall 40 so as to be on opposite sides of the second connector housing 28. Each of the pair of second projections 90 is also disposed on a respective side wall 42 of the second connector housing 28 and is closer to the front wall 38 relative to the first projections 88 so as to be on opposite sides of the second connector housing 28.

The adaptor 30 may include a pair of first guide rails 92 and a pair of second guide rails 94. The pair of first projections 88 are configured to be slidingly disposed within the pair of first guide rails 92 and the pair of second projections 90 are configured to be slidingly disposed within the pair of second guide rails 94. The pair of first projections 88 are arranged on opposite sides of the second connector housing 28 and the pair of second projections 90 are also arranged on opposite sides of the second connector housing 28. The pair of first guide rails 92 are spaced apart from and extend along the pair of second guide rails 94, wherein the adaptor 30 is movable between the first position (1P) and the second position (2P) by sliding the first projections 88 within a respective one of the pair of first guide rails 92 and sliding the second projections 90 within a respective one of the pair of second guide rails 94. In a preferred embodiment, the first guide rails 92 and the second guide rails 94 are generally "L" shaped so as to raise and lower the adaptor 30 while simultaneously positioning the adaptor between the rear and front of the second connector housing 28.

Referring again to the figures, also provided herein is a connector system 200. The connector system 200 is configured to be installed in a vehicle (not shown) so as to provide an electrical connection to an electric device (not shown) having a device case 300. The connector system 200 includes a first connector 96 to be mounted on a device case 300 of an in-vehicle device, the device case 300 houses the electric device. The connector system 200 includes a second connector 24 to be engaged with the first connector 96. A first fastening member 34 fixes the second connector 24 to the first connector 96. The first connector 96 includes a first terminal 14 and a first connector housing 12 for holding the first terminal 14. The second connector 24 includes a second terminal 26 fastened to the first terminal 14 by the first fastening member 34 and electrically connected to the first terminal 14. A second connector housing 28 accommodates the second terminal 26. An adaptor 30 is mounted on the second connector housing 28, the adaptor 30 being relatively movable with respect to the second connector housing 28.

A cover 32 is detachably mounted on the adaptor 30. The second connector housing 28 includes an opening 36 for providing access to the second terminal 26. The adaptor 30 is movable between a first position (1P) and a second position (2P). The second position (2P) is different from the first position (1P), wherein when the adaptor 30 is in the first position (1P) the cover 32 is separated from the opening 36 of the second connector housing 28 so as to provide access to the first terminal 14 and the second terminal 26, and when the adaptor 30 is in the second position (2P), the cover 32 closes the opening 36 of the second connector housing 28.

Figure 12:
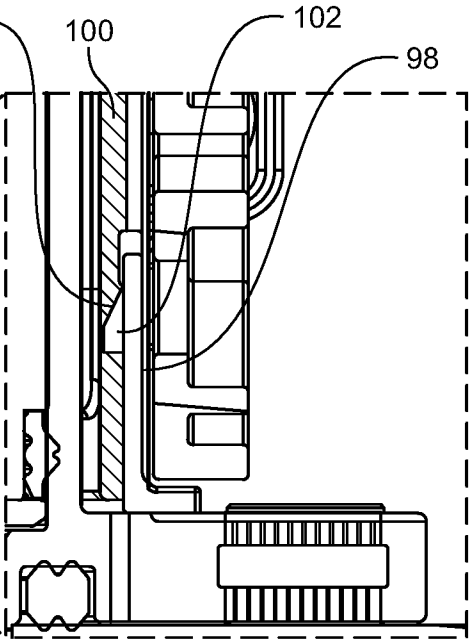
FIG. 12 is a close up view of the area circled in FIG. 11.
Figure 11:
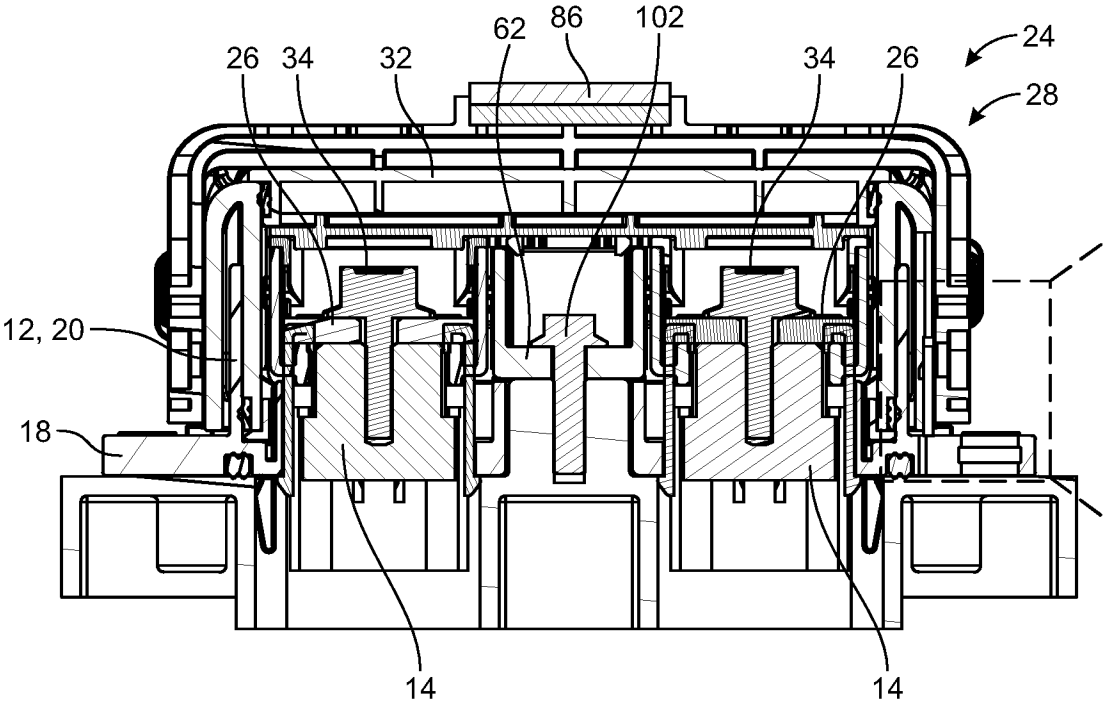
FIG. 11 is a cross-sectional view of the connector assembly shown in FIG. 6 taken along line 11-11.

With reference again to FIGS. 1 and 3*a* and now to FIGS. 11 and 12, in one aspect, the first connector housing 12 includes a guide portion 98 extending upwardly from a base 18 of the first connector housing 12 and the second connector housing 28 includes a guided portion 100 provided on the side wall 42 of the second connector housing 28. The guided portion 100 has a groove shape which is open to a bottom edge of the second connector housing 28. The guided portion 100 is slidable with respect to the guide portion 98. The guide portion 98 may include a third locking portion 102 configured to lock the second connector housing 28 to the first connector housing 12. In particular, the guided portion 98 includes a first connector holding portion 104, wherein the third locking portion 102 is configured to engage with the first connector holding portion 104. The first connector holding portion 104 is a depression formed on the side wall 42 of the second connector housing 28. The guide portion 98 may be formed of a resilient material so as to automatically bias the third locking portion 102 into engagement with the first connector holding portion 104. In one aspect, the connector assembly 10 includes a pair of guide portions 98 each disposed on opposite sides of the first connector housing 10 and spaced apart from the housing portion 20. The side walls 42 of the second connector housing 28 are dimensioned to be seated between the guide portions 98 and the housing portion 20 of the first connector housing 12. The second connector housing 28 includes a pair of guided portions 100, each disposed on a respective side wall 42 of the second connector housing 28.

In one aspect, the adaptor 30 covers the guide portion when being at the second position (2P).

In yet another aspect of a connector assembly 10, the connector assembly 10 is configured to mate with a first connector 96. The first connector 96 includes a first connector housing 12 for holding a first terminal 14 and is configured to be mounted on a metal-made device case 300 of an in-vehicle device and capable of accommodating a second terminal 26 electrically connectable to the first terminal 14.

The connector assembly 10 includes a second connector housing 28, an adaptor 30 and a cover 32. The second connector housing 28 accommodates the second terminal 26. The adaptor 30 is configured to be mounted on the second connector housing 28. The adaptor 30 is movable with respect to the second connector housing 28. The cover 32 is detachably mounted to the adaptor 30. The second connector housing 28 includes an opening 36 for providing access to the second terminal 26.

The adaptor 30 is movable between a first position (1P) and a second position (2P) different from the first position (1P). In the first position (1P) the cover 32 is separated from the opening 36 of the second connector housing 28 and the first terminal 14 and the second terminals 26 are accessible so as to be able to be fastened together by a first fastening member 34. In the second position (2P), the cover 32 closes the opening 36 of the second connector housing 28.

In one aspect, the second connector housing 28 includes an outer housing 60 made of metal and capable of accommodating an inner housing 58. The outer housing 60 includes an electrically connecting portion 62 electrically connectable to the device case 300 by being fastened to the device case 300 by a second fastening member 64. Wherein, the electrically connecting portion 62 is arranged inside the outer housing 60. When the adaptor 30 the first position, the cover 32 is separated from the opening 36 of the outer housing 60 so as to make the device case 300 and the electrically connecting portion 62 accessible for fastening by the second fastening member 64. When the adaptor 30 is in the second position the cover 32 closes the opening 36 so as to protect the electrically connecting portion 62 and the device case 300.

Accordingly, a connector assembly 10 and a connector system 200 is provided wherein the service cover 32 does not require handling so as to decrease the complexity of installation relative to current practice. Further the connector assembly 10 and connector system 200 disclosed herein is configured to assist in the positioning of the service cover 32 onto the opening 36.

While particular embodiments have been illustrated and described herein, it should be appreciated and understood that various other changes and modifications may be made without departing from the spirit and scope of the claim subject matter. Moreover, although various aspects of the claim subject matter have been described herein, such aspects need not be utilized in combination. It is therefore intended that the appended claims cover all such changes and modifications that are within the scope of the claim subject matter.

The invention claimed is:

1. A connector assembly configured to mate a first connector housing having a first terminal electrically connected to a wire, the connector assembly comprising:

a second connector configured to be mounted on an end part of the wire, wherein:

the second connector includes:

a second terminal electrically connectable to the first terminal, the second terminal being electrically connected to the wire;

a second connector housing for accommodating the second terminal, the second connector housing including an opening for providing access to the second terminal;

an adaptor coupled to the second connector housing, the adaptor being movable with respect to the second connector housing; and a cover detachably mounted to the adaptor, wherein the adaptor is movable between a first position and a second position, the second position being different from the first position, and wherein in the first position the cover is separated from the opening of the second connector housing so as to provide access to the first terminal and the second terminal, and wherein in the second position the cover is closes the opening of the second connector housing.

2. The connector assembly as set forth in claim 1, wherein:

the second connector housing includes an inner housing made of resin, the second terminal disposed within the inner housing, and an outer housing made of metal for accommodating the inner housing, the outer housing includes an electrically connecting portion electrically connectable to the device case, the electrically connecting portion is arranged inside the outer housing, the adaptor is mounted on the outer housing of the second connector housing, the opening includes a first opening formed in the inner housing and a second opening formed in the outer housing, wherein the first opening overlaps the second opening, the cover is separated from the second opening of the outer housing and the device case and the electrically connecting portion are fastened together by a second fastening member when the adaptor is at the first position.

3. The connector assembly of claim 2, wherein:

the second terminal is a plurality of second terminals, the inner housing is a plurality of inner housings, the plurality of second terminals are individually accommodated in the plurality of inner housings, the plurality of inner housings are accommodated side by side in the outer housing, and the electrically connecting portion is arranged between the plurality of inner housings.

4. The connector assembly of claim 2, wherein:

the wire includes a core, a first insulation coating surrounding the core, a braided wire surrounding the first insulation coating and a second insulation coating surrounding the braided wire, the second connector includes a shield retainer to be accommodated into the outer housing and mounted in the outer housing, the braided wire includes a shield connecting portion exposed from the second insulation coating, and the shield retainer is electrically connected to the shield connecting portion and electrically connected to the outer housing.

5. The connector assembly of claim 4, wherein the shield retainer is fastened to the outer housing by a third fastening member.

6. The connector assembly of claim 5, wherein the shield retainer includes a first divided body and a second divided body separable from the first divided body.

7. The connector assembly of claim 1, wherein:

the adaptor includes a first locking portion lockable to the second connector housing when being at the first position, the second connector housing includes a first adaptor holding portion, the first locking portion being lockable to the first adaptor holding portion, and the first locking portion is locked to the first adaptor holding portion when the adaptor is at the first position.

8. The connector assembly of claim 1, wherein:

the adaptor includes a second locking portion lockable to the second connector housing, the second connector housing includes a second adaptor holding portion, the second locking portion being lockable to the second adaptor holding portion, and the second locking portion is locked to the second adaptor holding portion when the adaptor is at the second position.

9. The connector assembly of claim 8, wherein the adaptor includes a lock portion for suppressing the release of a locked state of the second locking portion to the second connector housing.

10. The connector assembly of claim 1, wherein:

the second connector includes a pair of first projections and a pair of second projections, the adaptor includes a pair of first guide rails and a pair of second guide rails, the pair of first projections slidingly disposed within the pair of first guide rails and the pair of second projections slidingly disposed within the pair of second guide rails, the pair of first projections are arranged on opposite sides of the second connector housing, the pair of second projections are arranged on opposite sides of the second connector housing, the pair of first guide rails are spaced apart from and extend along the pair of second guide rails, and the adaptor is movable between the first position and the second position by sliding a respective one of the pair of first projections within a respective one of the pair of first guide rails and a respective one of the pair of second projections within a respective one of the pair of second guide rails.

11. The connector assembly of claim 1, wherein the electrically connecting portion electrically connectable to the device case by being fastened to the device case by a second fastening member.

12. A connector system to be installed in a vehicle so as to provide an electrical connection to an electric device, the connector system comprising:

a first connector to be mounted on a device case of an in-vehicle device, the device case housing the electric device;

a second connector to be engaged with the first connector; and a first fastening member fixes the second connector to the first connector, wherein:

the first connector includes:

a first terminal; and a first connector housing for holding the first terminal, the second connector includes:

a second terminal to be fastened to the first terminal by the first fastening member and electrically connected to the first terminal;

a second connector housing for accommodating the second terminal;

an adaptor to be mounted on the second connector housing, the adaptor being relatively movable with respect to the second connector housing, and a cover detachably mounted to the adaptor, the second connector housing includes an opening for providing access to the second terminal, the adaptor is movable between a first position and a second position, the second position different from the first position, wherein when the adaptor is in the first position the cover is separated from the opening of the second connector housing so as to provide access to the first terminal and the second terminal, and when the adaptor is in the second position, the cover closes the opening of the second connector housing.

13. The connector system of claim 12, wherein:

the first connector housing includes a guide portion extending upwardly from a base of the connector housing, the second connector housing includes a guided portion provided on an outer side surface of the second connector housing and having a groove shape which is open to a bottom edge of the second connector housing, and the guided portion is slidable with respect to the guide portion.

14. The connector system of claim 13, wherein:

the guide portion includes a third locking portion lockable to the second connector housing, the guided portion includes a first connector holding portion, the third locking portion being lockable to the first connector holding portion.

15. The connector system of claim 14, wherein the adaptor covers the guide portion when being at the second position.

16. A connector assembly configured to mate with a first connector, the first connector including a first connector housing for holding a first terminal and to be mounted on a metal-made device case of an in-vehicle device and capable of accommodating a second terminal electrically connectable to the first terminal, the connector assembly comprising:

a second connector housing accommodating the second terminal;

an adaptor to be mounted on the second connector housing, the adaptor being movable with respect to the second connector housing; and a cover detachably mounted to the adaptor, wherein:

the second connector housing includes an opening for providing access to the second terminal, the adaptor movable between a first position and a second position different from the first position, wherein in the first position the cover is separated from the opening of the second connector housing and the first terminal and the second terminal are accessible so as to be fastened to each other by a first fastening member, and in the second position the cover closes the opening of the second connector housing so as to protect the first terminal and the second terminal.

17. The connector assembly of claim 16, wherein:

the second connector housing includes an outer housing made of metal and capable of accommodating an inner housing, the outer housing includes an electrically connecting portion electrically connectable to the device case by being fastened to the device case by a second fastening member, the electrically connecting portion is arranged inside the outer housing, wherein when the adaptor is in the first position, the cover is separated from the opening of the outer housing so as to make the device case and the electrically connecting portion accessible for fastening by the second fastening member, and when the adaptor is in the second position the cover closes the opening so as to protect the electrically connecting portion and the device case.

* * * * *